US007258593B2

(12) United States Patent
Mineconzo

(10) Patent No.: US 7,258,593 B2
(45) Date of Patent: Aug. 21, 2007

(54) CAMISOLE FOR MASTECTOMY PATIENTS

(76) Inventor: Jean Mineconzo, c/o Jean's Camisoles, 525 Harrison Ave., Schenectady, NY (US) 12306

( * ) Notice: Subject to any disclaimer, the term of this patent is extended or adjusted under 35 U.S.C. 154(b) by 0 days.

(21) Appl. No.: 11/329,279

(22) Filed: Jan. 11, 2006

(65) Prior Publication Data

US 2007/0161327 A1 Jul. 12, 2007

(51) Int. Cl.
*A41C 3/00* (2006.01)
*A41D 13/00* (2006.01)

(52) U.S. Cl. ..... 450/1; 2/73; 2/114

(58) Field of Classification Search ..... 2/105, 2/106, 115, 113, 114, 73, 78.1–78.4, 69, 102, 2/109, 108; 128/877, 874, 869
See application file for complete search history.

(56) References Cited

U.S. PATENT DOCUMENTS 4,164,792 A * 8/1979 Ito ..... 2/108
6,048,252 A * 4/2000 Sebring ..... 450/1
6,574,800 B1 * 6/2003 Leger et al. ..... 2/114

* cited by examiner

*Primary Examiner*—Gloria M. Hale
(74) *Attorney, Agent, or Firm*—Sughrue Mion, PLLC

(57) ABSTRACT

A camisole for use by medical patients includes front and rear segments with the front segment divided into two panels which may be selectively temporarily closed. The front panels are connected to the rear panels along side seams and the garment includes a yoke-like neck area and arm receiving openings. A loop is secured in each side seam below each arm opening for guarding drainage tubes and pockets are sewn into the side seams and lower hem for receiving drainage bulbs.

9 Claims, 3 Drawing Sheets

CAMISOLE FOR MASTECTOMY PATIENTS

RELATED PATENT APPLICATIONS

None.

FIELD OF THE INVENTION

The present invention is directed to an article of apparel and more specifically to a camisole style garment intended for use by mastectomy patients.

BACKGROUND OF THE INVENTION

Subsequent to a mastectomy and prior to any permanent corrective surgery, such as an implant, mastectomy patients have a psychological need for at least a temporary replacement of the breast or breasts. Artificial breasts have been provided and used in the past and various garments of wearing apparel have been provided to accommodate the wearing of these items. Such garments are generally provided with pockets to receive the artificial breast or breasts so that the wearer, when wearing the garment will appear to the casual observer to be unaffected by the surgical process. Such garments are important to the mental wellbeing of the patient after undergoing such a traumatic operation.

Other difficulties encountered following such surgery involves the tubes which have been inserted into the chest area of the patient for drainage or other purposes. Drainage bulbs for receiving fluids are attached to these tubes. In order to do so with the existing garments, it necessary to pass the tubes through the neck opening, the arm openings or the bottom edge of the garment thereby substantially reducing the beneficial aesthetic benefits initially obtained from wearing the garment.

SUMMARY OF THE INVENTION

The present invention is directed to a new and improved camisole specifically designed for mastectomy patients to accommodate drainage tubes and bulbs completely inside the garment so as to improve the aesthetic appearance of the garment.

Fabric loops are sewn in the garment below the arm opening on each side of the garment to guide drainage tubes to one side of the garment or the other. Interior pockets are provided below the tabs for receiving drainage bulbs which in turn are connected to the drainage tubes. The overall result is an aesthetically pleasing camisole having interior guides and pockets for discretely receiving drainage tubes and bulbs in a manner in which they would be invisible from the exterior of the camisole.

DETAILED DESCRIPTION OF THE INVENTION

Figure 3:
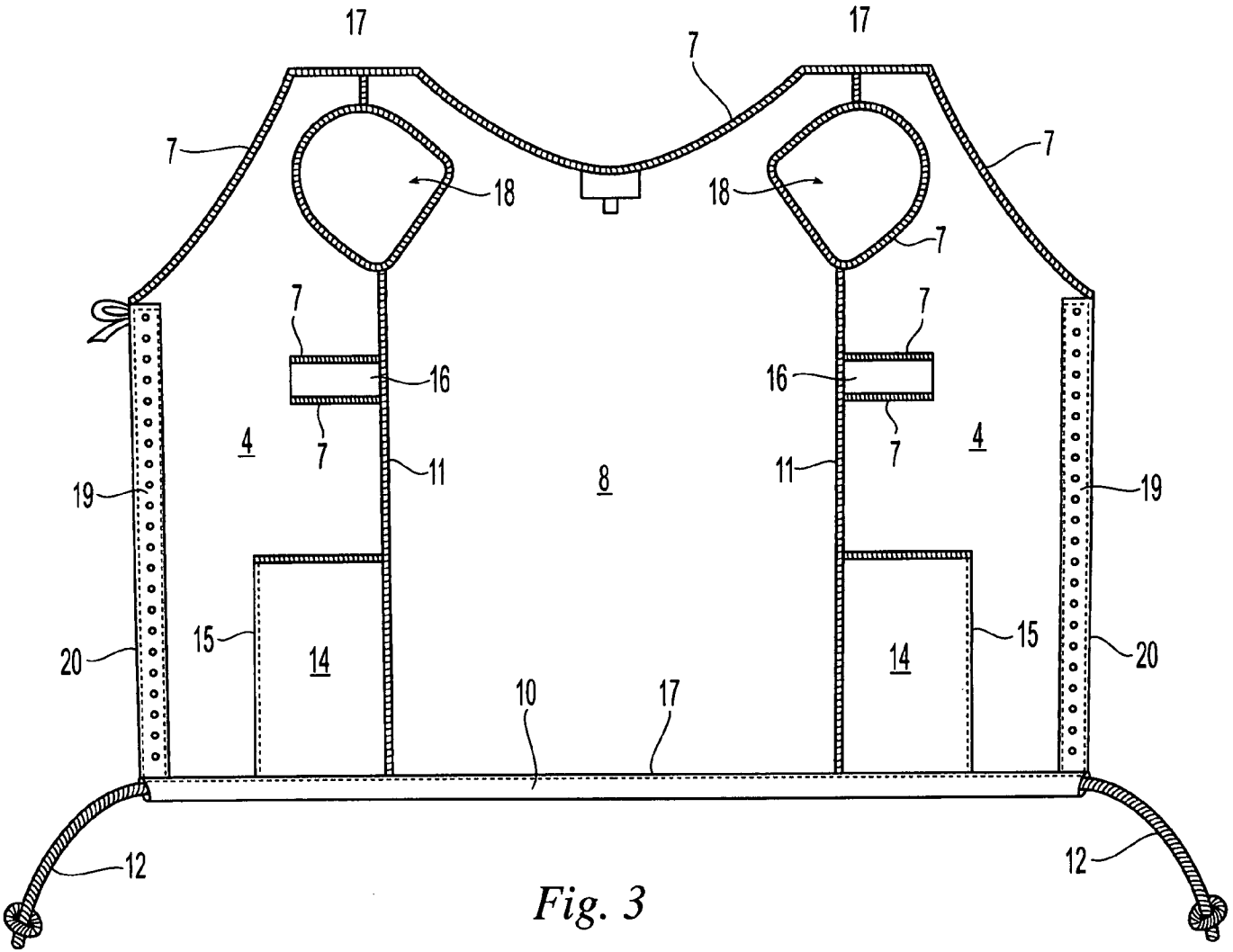
FIG. 3 is an interior view of the camisole shown in FIG. 2.

As best seen in FIG. 3, the camisole according to the present invention is comprised of a rear panel 8 and two front panels 4 connected thereto along by the side seams 11 of the garment. A pair of arm openings 18 are provided adjacent to the top of the camisole. The arm openings as well as the upper edges of the camisole are each provided with a surged finished edge 7. The bottom edge of the camisole is folded up and stitched at 17 to provide a drawstring pocket 10 for accommodating the drawstring 12.

Figure 1:
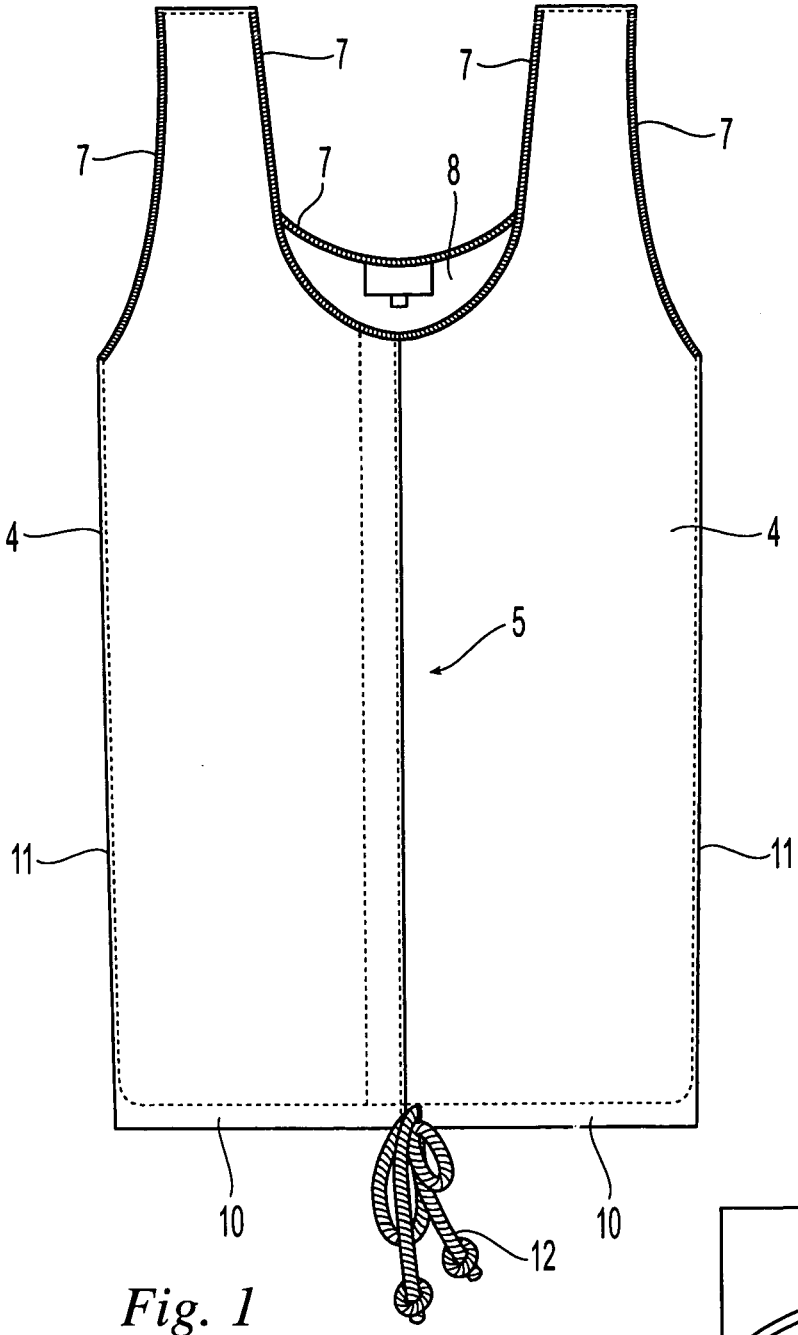
Fig. 1 (Prior Art)
FIG. 1 is a front elevation of a prior art camisole which is not provided with means for accommodating drainage tubes and bulbs.
Figure 1A:
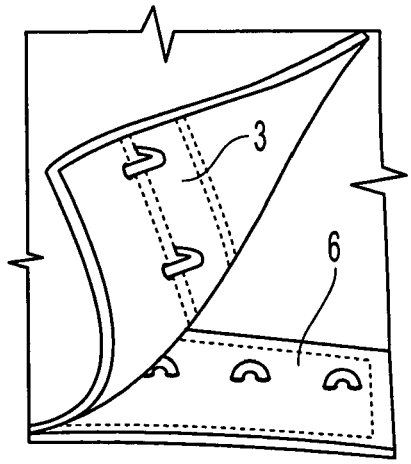
Fig. 1A (Prior Art)
FIG. 1A is a partial view of the front closure of FIG. 1 with the fasteners in a partially opened condition.

In the prior art camisole of FIG. 1, a front closure 5 is provided in the form of two hook-and-eye tapes which cooperate with each other to close the garment. In the camisole according to the present invention, the front closure is comprised of complimentary snap bearing tapes 19 which are sewn along the front edges of the garment at 20. The snaps closure elements 21 and 22 are shown in detail in FIG. 2A.

Figure 2:
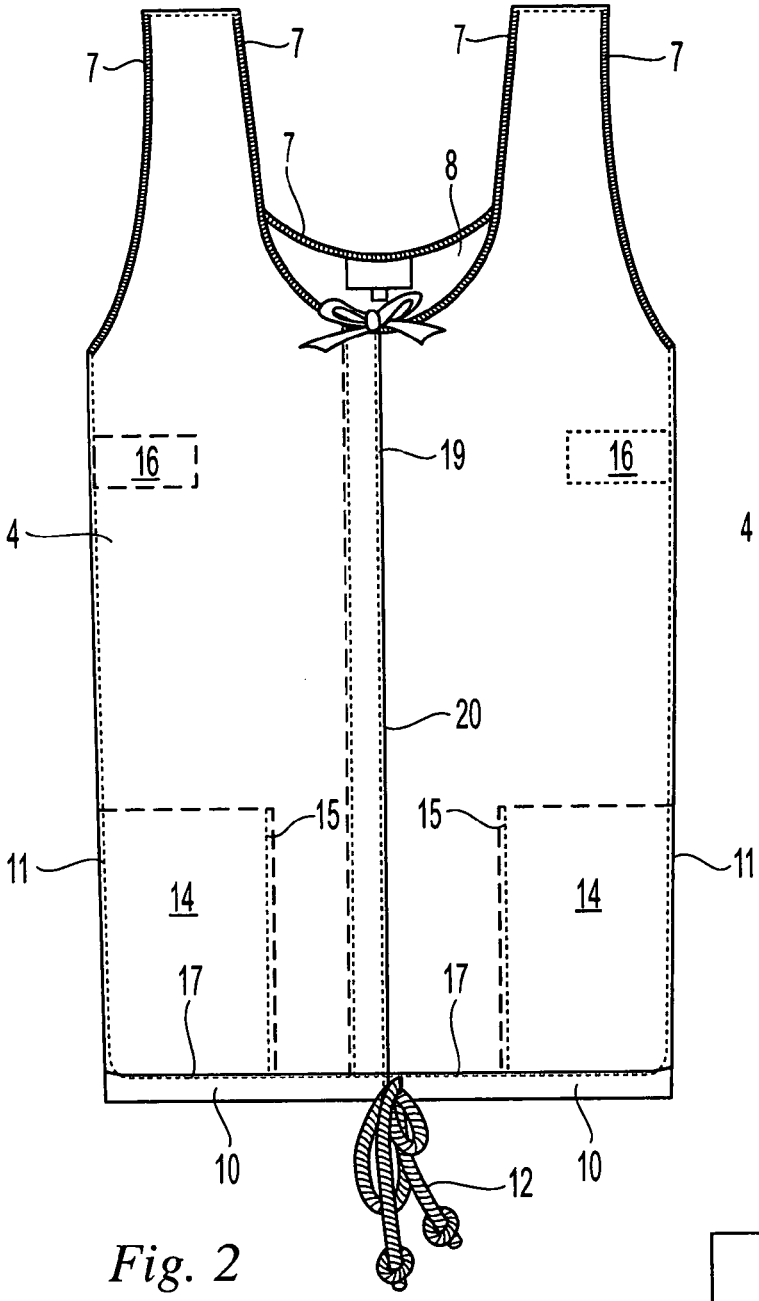
FIG. 2 is a front elevational view of a camisole according to the present invention showing the relationship of the drainage guides and bulb receiving pockets within the camisole.
Figure 2A:
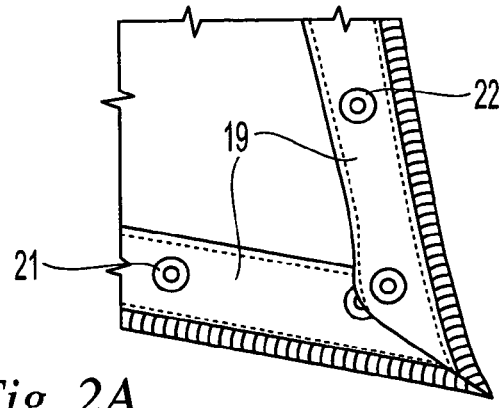
FIG. 2A is a partial view of the front closure taken along the lines B-B in FIG. 2 with the fasteners in a partially opened position.

As shown in FIGS. 2 and 3, the camisole is provided with a pair of drainage bulb receiving pockets 14 which are secured to the two front panels respectively by stitches 15 along one edge parallel to the front opening and an opposite edge secured by the stitching 11 joining the front and rear panels together. The lower edge of the pocket is secured by the stitches 17 defining the drawstring pocket. The upper edges of the pockets are open for receiving the drainage bulbs.

Directly above the two pockets are two fabric loops 16 which are secured in the side seams 11 joining the front and rear panels together. The fabric loop 16 in each case provides a passage for the drainage tube to properly position the drainage tube along the stitching 11 joining the front and rear panels. The edges of the loop 16 are provided with surged finished edges 7.

While a full and complete description of the invention has been set forth in accordance with the dictates of the patent statutes, it should be understood that modifications can be resorted to without departing from the spirit or the scope of the appended claims.

What is claimed is:

1. A camisole for use by mastectomy patients comprising a rear panel and two front panels secured to the rear panel along vertically extending side seams, fastener means disposed along overlapping front edges of the front panels for securing the front edges of the camisole, guide means for drainage tubes secured in said side seams and located on an inside of the camisole in spaced relation to the two arm holes such that the guide means is not visible from an outside of the camisole and two pockets each disposed adjacent to a side seam and a drawstring pocket secured to said front panels by stitching.

2. A camisole as set forth in claim 1, wherein said securing means for closing the front of the camisole are comprised of snap fasteners.

3. A camisole as set forth in claim 1, wherein said guide means each comprised of a fabric loop having opposite ends secured together in a side seam.

4. A camisole as set forth in claim 1, wherein the two pockets are disposed inside the camisole or respective front panels below a respective arm opening.

5. A camisole as set forth in claim 1, wherein guide means is disposed adjacent to a breast portion of to camisole to receive a drainage tube from a breast of a user.

6. A camisole for use by mastectomy patients, comprising:

a rear panel having a top, bottom and opposite sides;

two front panels each connected to opposite sides of the rear panel at respective seam portions;

a pocket disposed inside the camisole on one of the front panels below an arm opening; and a guide support secured by one of to seam portions and configured to support a drainage tube, wherein the guide support is located on an inside of the camisole such that the guide support is no visible from an outside of the camisole.

7. The camisole according to claim 6, wherein to guide support comprises a fabric loop having opposite ends secured in to seam portion.

8. The camisole according to claim 6, wherein the guide support is inside the camisole.

9. The camisole according to claim 7, wherein the guide support is adjacent to a breast portion of the camisole to receive a drainage tube from a breast of a user.

* * * * *